US005979890A

United States Patent [19]

Fujimaki et al.

[11] Patent Number: 5,979,890

[45] Date of Patent: Nov. 9, 1999

[54] SHEET TRANSFER SYSTEM

[75] Inventors: Fumio Fujimaki, Tokyo; Kimihiko Furuya, Yamanashi-ken, both of Japan

[73] Assignee: Riso Kagaku Corporation, Tokyo, Japan

[21] Appl. No.: 08/853,591

[22] Filed: May 9, 1997

[30] Foreign Application Priority Data

May 13, 1996 [JP] Japan ..... 8-117521

[51] Int. Cl.[6] ..... G03B 27/64

[52] U.S. Cl. ..... 271/195; 271/197

[58] Field of Search ..... 271/195, 196, 271/197, 184, 225

[56] References Cited

U.S. PATENT DOCUMENTS

| | | | |
|---|---|---|---|
| 2,474,997 | 7/1949 | Wormser . | |
| 3,937,459 | 2/1976 | Lawrence . | |
| 4,032,134 | 6/1977 | Dalmau | 271/195 |
| 4,033,694 | 7/1977 | Ferrari | 271/195 |
| 4,285,507 | 8/1981 | Marinoff | 271/195 |
| 5,379,999 | 1/1995 | Barzideh et al. . | |
| 5,398,925 | 3/1995 | Zeltner | 271/195 |
| 5,501,147 | 3/1996 | Jaffa et al. | 271/195 |
| 5,600,906 | 2/1997 | Hamid | 271/197 |

FOREIGN PATENT DOCUMENTS

| | | |
|---|---|---|
| 3411029 | 10/1985 | Germany . |
| 3629720 | 4/1987 | Germany . |
| 29501537 | 4/1995 | Germany . |
| 1365323 | 8/1974 | United Kingdom . |

*Primary Examiner*—Christopher P. Ellis
*Assistant Examiner*—Gregory A. Morse
*Attorney, Agent, or Firm*—Sixbey, Friedman, Leedom & Ferguson, P.C.; Donald R. Studebaker

[57] ABSTRACT

A sheet is conveyed by a conveyor belt which attracts the back side of the sheet under vacuum along a conveyance passage including a bent portion. An air blower is provided to blow an air flow against the upper surface of the conveyor belt at the bent portion of the conveyance passage so that the sheet is bent along the surface of the conveyor belt.

6 Claims, 4 Drawing Sheets

SHEET TRANSFER SYSTEM

BACKGROUND OF THE INVENTION

1. Field of the Invention

This invention relates to a sheet transfer system which conveys sheets attracting the back side thereof under vacuum without contacting the front side of the sheets for use, for instance, in a sheet sorter which is provided with a plurality of bins each of which receives a plurality of sheets discharged from an image recording apparatus such as a printer, a copier or the like and forms thereon a stack of sheets.

2. Description of the Related Art

Generally sheets are conveyed held between a pair of conveyor rollers. However in the case of sheets carrying thereon wet ink like printed sheets just discharged from a printer such as a stencil printer, such conveyor rollers cannot be used since the rollers are contaminated with ink and the images on the sheets are deteriorated through contact of the rollers with the printed sides of the sheets. Accordingly sheets wet with ink are conveyed by a system which conveys sheets attracting the back side thereof under vacuum without contacting the front side of the sheets.

In order to make compact an apparatus such as a sheet sorter, it is necessary to bend the conveyance passage of the sheets, for instance, at an acute angle.

In the case of a transfer system in which the sheets are conveyed with the back side thereof attracted against a conveyor belt under vacuum, it is difficult to attract the sheets so that the sheets are sufficiently bent along the bent conveyance passage unless a substantially large suction apparatus is used since the sheets are spaced from each other and the vacuum system is not closed. Especially when the sheets are large in thickness or the conveying speed is high, the leading end portion of the sheet will project outside the conveyance passage away from the conveyor belt when passing the bent portion of the conveyance passage, which can result in jam of the transfer system.

SUMMARY OF THE INVENTION

In view of the foregoing observations and description, the primary object of the present invention is to provide a sheet transfer system which conveys sheets holding their back sides without contacting their front sides and can surely convey the sheets even if the conveyance passage is bent.

The sheet transfer system of the present invention is characterized in that an air blower is provided to blow an air flow against the surface of the conveyor at the bent portion of the conveyance passage so that the sheets are bent along the surface of the conveyor.

Specifically the sheets are conveyed by a conveyor belt which attracts the back sides of the sheets under vacuum and the conveyor belt is bent along a pulley.

It is preferred that an exhaust fan be provided to exhaust air in a direction perpendicular to the direction of conveyance of the sheets inside of the bent portion of the conveyance passage.

Preferably the exhaust fan is provided inside of a pulley along which the conveyance passage is bent and which is rotated about a rotational axis perpendicular to the direction of conveyance of the sheets in view of simplifying the structure.

Further it is preferred that a plurality of blowers be arranged in the direction of conveyance around the bent portion with at least one of the blowers positioned so as to blow an air flow against the top portion of bent portion and the air flow from said at least one of the blowers be stronger than those from the other blowers. This arrangement is advantageous in that the sheet can be surely bent along the bent portion of the conveyance passage by blowing a strong air flow against a place where the sheet is the toughest.

Preferably the strength of the air flow blown from the air blower is adjustable according to the kind of sheets to be conveyed.

More specifically the strength of the air flow blown from the air blower is increased as the thickness of the sheets to be conveyed increases.

In the sheet transfer system of the present invention, the sheets are bent along the bent portion of the conveyance passage by the air blower, whereby the sheets can be successfully conveyed along the bent portion of the conveyance passage without contacting the front side of the sheets with no fear that the sheets project outside the conveyance passage.

When an exhaust fan is provided to exhaust air in a direction perpendicular to the direction of conveyance of the sheets inside of the bent portion of the conveyance passage, the air which is blown from the air blower and enters the inside of the conveyance passage is prevented from disturbing the air flow to be blown against following sheets and from adversely affecting vacuum attracting the sheets, whereby the sheets can be more surely conveyed along the bent portion of the conveyance passage.

Further when the strength of the air flow blown from the air blower is adjustable according to the kind of sheets to be conveyed, the sheets can be bent along the bent portion of the conveyance passage by an air flow whose strength is optimal to bend the sheets according to the resiliency of the sheets which varies according to the material, thickness and the like of the sheets, whereby the sheets can be more surely conveyed along the bent portion of the conveyance passage without adverse affect of an excessively strong air flow.

DESCRIPTION OF THE PREFERRED EMBODIMENT

Figure 1:
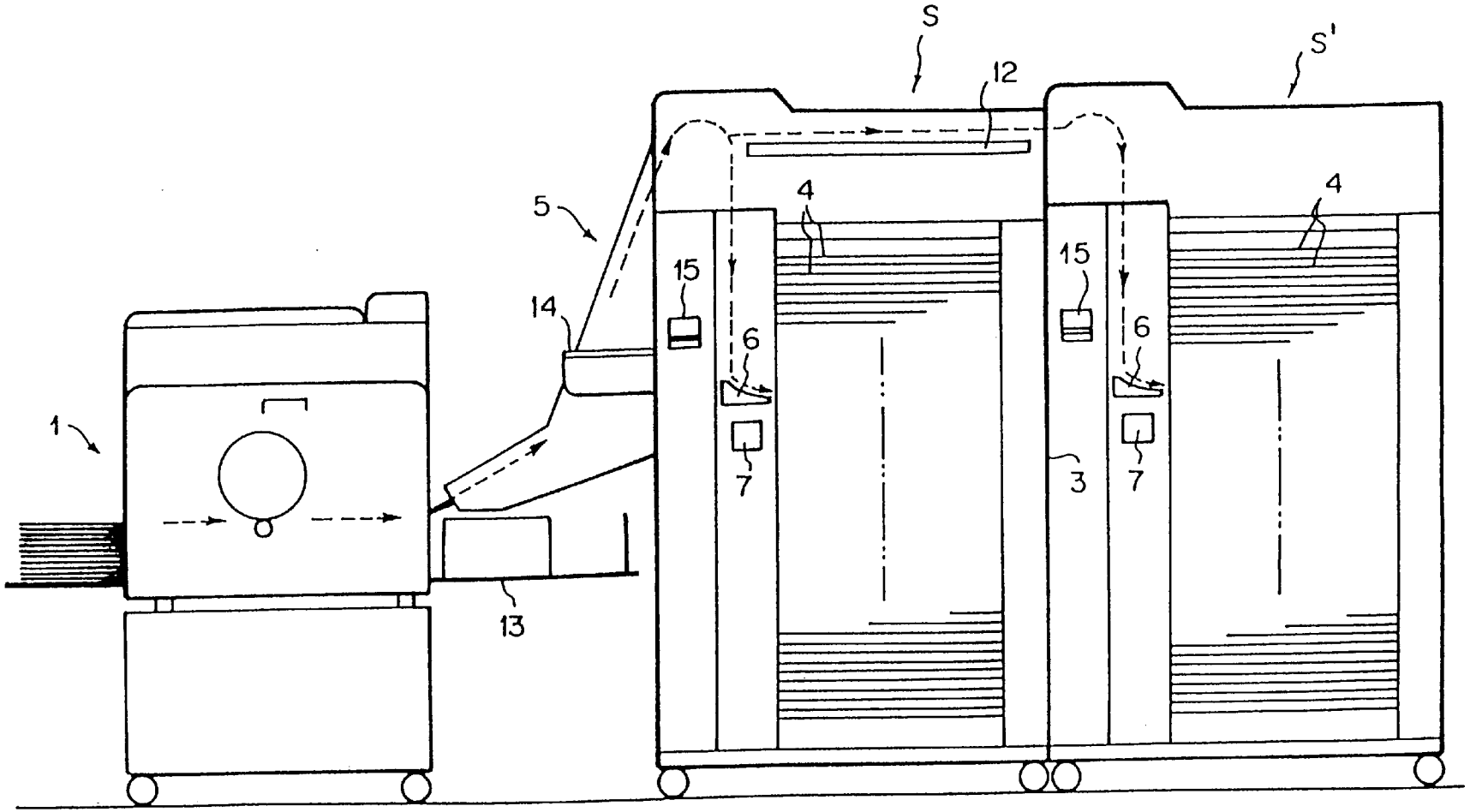
FIG. 1 is a schematic side view showing a sheet sorter provided with a sheet transfer system in accordance with an embodiment of the present invention with the sorter connected to an image recording apparatus.
Figure 2:
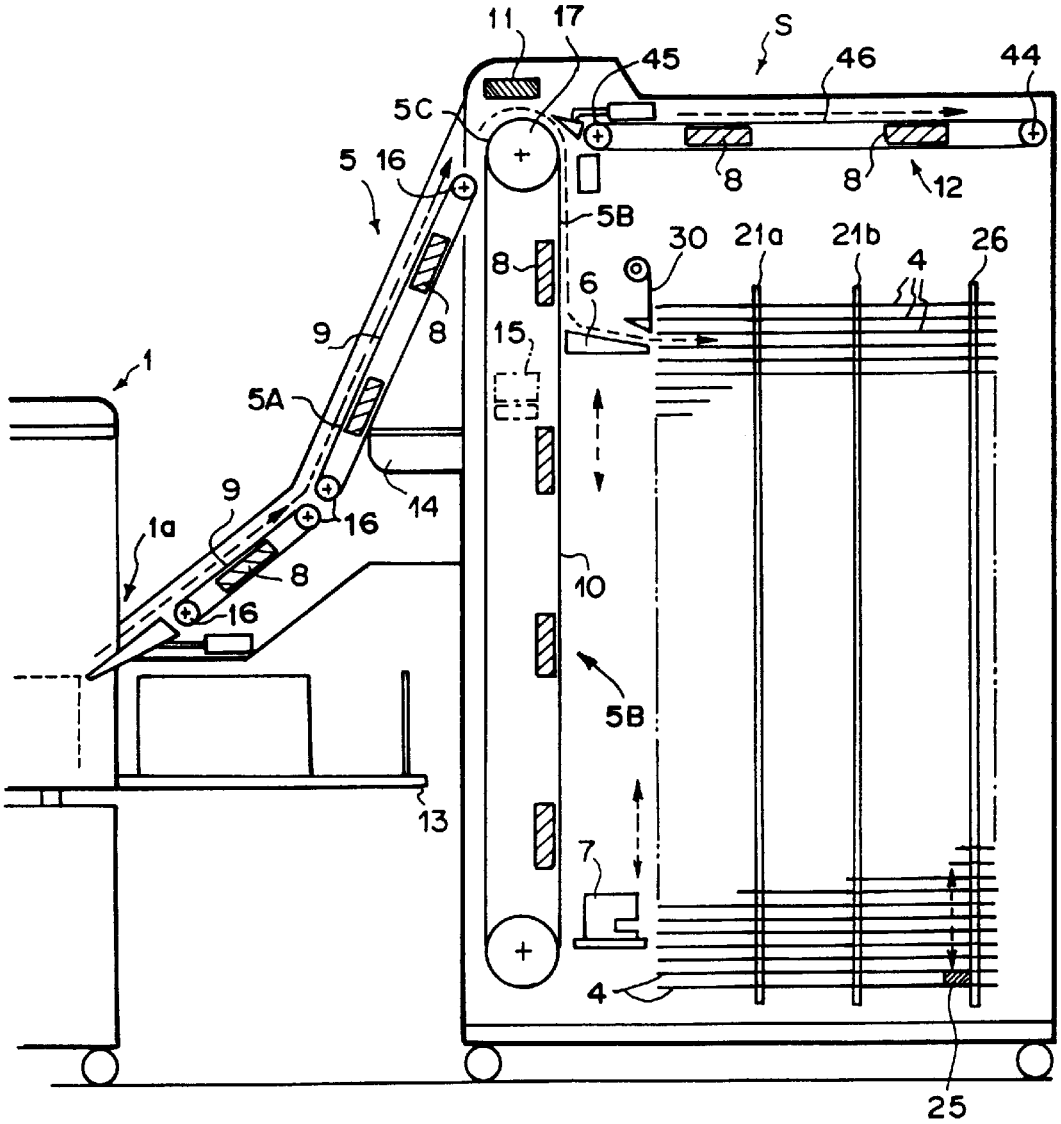
FIG. 2 is a side through-view showing the internal structure of the sorter shown in FIG. 1.

In FIGS. 1 and 2, a sheet sorter S comprises a plurality of (e.g., fifty) bins (sort trays) 4 which are disposed in fixed positions in a frame 3 at predetermined intervals in the vertical direction and receive a plurality of recorded sheets 2 discharged from an image recording apparatus 1 such as a printer to form a stack of the sheets 2 on each bin 4, a sheet transfer system 5 which transfers the sheets 2 discharged from the image recording apparatus 1 toward the bins 4, an indexer 6 which is movable up and down along the array of the sheet inlet ends of the bins 4 and distributes the sheets 2, transferred by the sheet transfer system 5, to the respective bins 4 by a curved guide surface which deflects the sheets 2, and a stapler 7 which is movable up and down along the array of the sheet inlet ends of the bins 4 and in a horizontal direction and staples the stack of sheets on each bin 4.

In the case where the image recording apparatus 1 is a printer, especially a stencil printer, a number of sheets can be printed in a short time and recorded sheets 2 carrying thereon wet ink are discharged at a high rate. Accordingly no conveyor roller is used in the sheet transfer system 5 and the sheet transfer system 5 conveys the sheets 2 attracting the back sides thereof under vacuum without contacting the front sides of the sheets 2.

The sheet transfer system 5 comprises a first conveyor portion 5A which extends obliquely upward to an upper portion of the sheet sorter S and a second conveyor portion 5B which vertically extends downward along the path of travel of the indexer 6. The upper portions of the first and second conveyor portions 5A and 5B are at an acute angle relative to each other to form a bent portion 5C. That is, the sheets 2 discharged from the image recording apparatus 1 is conveyed obliquely upward to the bent portion 5C by the first conveyor portion 5A and delivered to the second conveyor portion 5B by way of the bent portion 5C.

The first conveyor portion 5A basically comprises a pair of perforated endless conveyor belts 9 each passed around a pair of pulleys 16 and suction blowers 8 disposed inside the conveyor belts 9, and conveys the sheets 2 with the back side of the sheets 2 attracted against the belts 9 under vacuum applied by the suction blowers 8. The second conveyor portion 5B basically comprises a perforated endless conveyor belt 10 passed around a pair of pulleys 17 and suction blowers 8 disposed inside the conveyor belt 10, and conveys the sheets 2 with the back side of the sheets 2 attracted against the belt 10 under vacuum applied by the suction blowers 8. As will be described in detail later with reference to FIG. 3 and 4, an air blower 11 blows an air flow against the surface of the conveyor belt 10 at the bent portion 5C, thereby pressing the sheets 2 against the surface of the conveyor belt 10.

In this particular embodiment, the sheet sorter S is arranged so that a plurality of slaves S' having the same structure as the main sheet sorter S can be connected to the sheet sorter S as shown in FIG. 1 in order to increase the total number of the bins 4. The slaves S' are connected to the main sheet sorter S on the side remote from the image recording apparatus 1. A sheet conveyor 12 is demountably mounted on an upper portion of the main sheet sorter S and the sheets 2 in the main sheet sorter S are transferred to the slaves S' by the sheet conveyor 12 when the slaves S' are connected to the main sheet sorter S.

The image recording apparatus 1 is provided with a sheet tray 13 on which the discharged sheets 2 are stacked when sorting of the sheets 2 is not necessary. Further a control panel 14 and an exterior electric stapler 15 are mounted on the outer surface of the sheet sorter S.

As shown in FIG. 2, there vertically extend through the plurality of bins 4 a pair of side lineup rods 21*a* and 21*b* which push the sheet 2 in the direction of width of the sheet 2 and bring the side edge of the sheet 2 into abutment against the side edge reference surface, and a trailing edge lineup rod 26 which pushes the leading edge of the sheet 2 to move the sheet 2 toward the sheet inlet end of the bin 4 so that the trailing edge of the sheet 2 is brought into abutment against a trailing edge reference surface defined by a metal web 30 which is fed out from a roll to close the sheet inlet ends of the bins 4 above the indexer 6 in response to a downward movement of the indexer 6 and is taken up around the roll in response to an upward movement of the indexer 6. A sheet stack ejector 25 is mounted on the rod 26 to be movable up and down along the rod 26. After completion of distribution of the sheets 2 to all the bins 4 by the indexer 6, the sheet stack ejector 25 pushes the sheet stacks 20 on the respective bins 4 to eject them into the path of travel of the indexer 6 for stapling operation.

Figure 3:
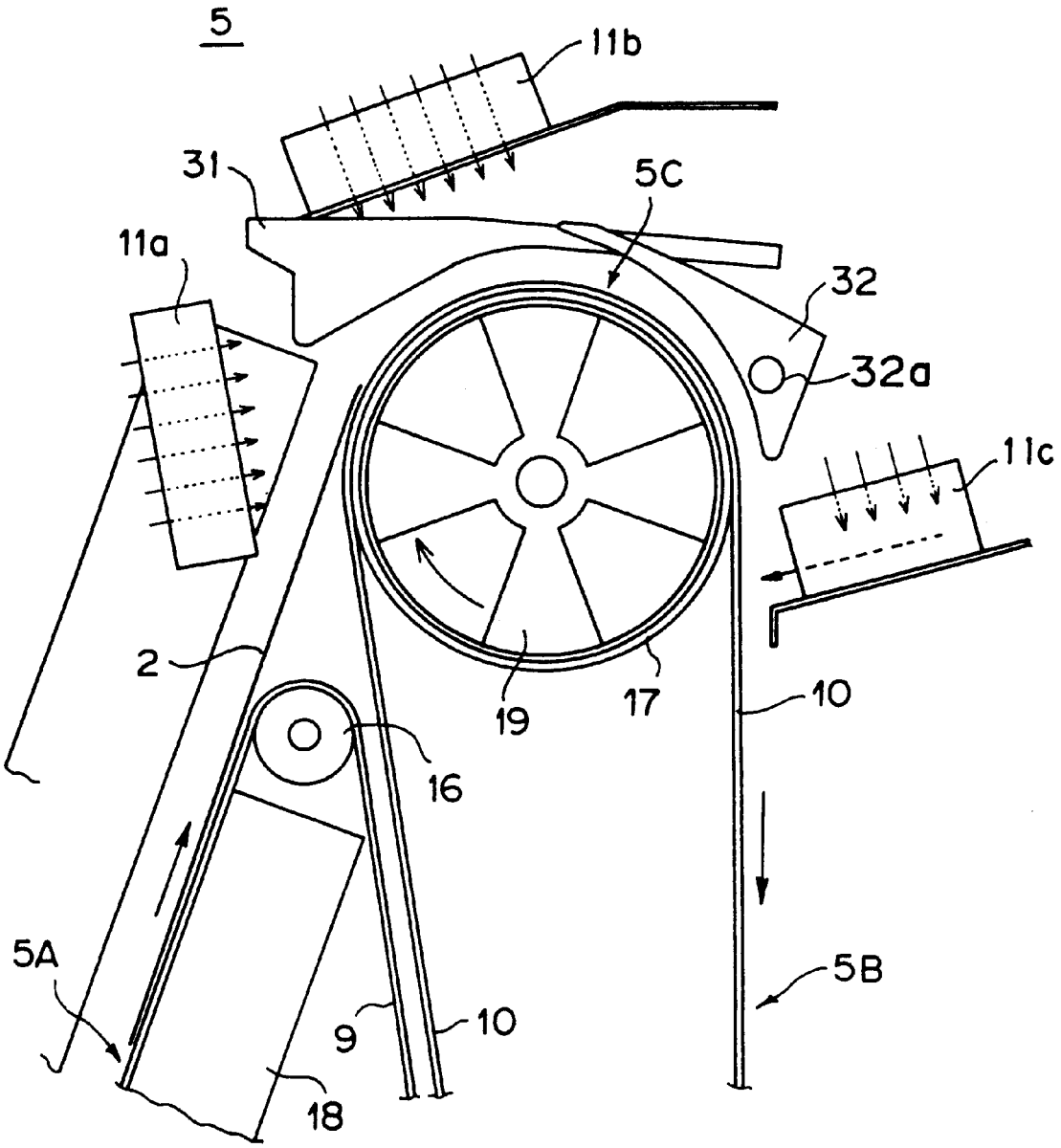
FIG. 3 is a side view showing the bent portion of the conveyance passage of the sheet transfer system of this embodiment.
Figure 4:
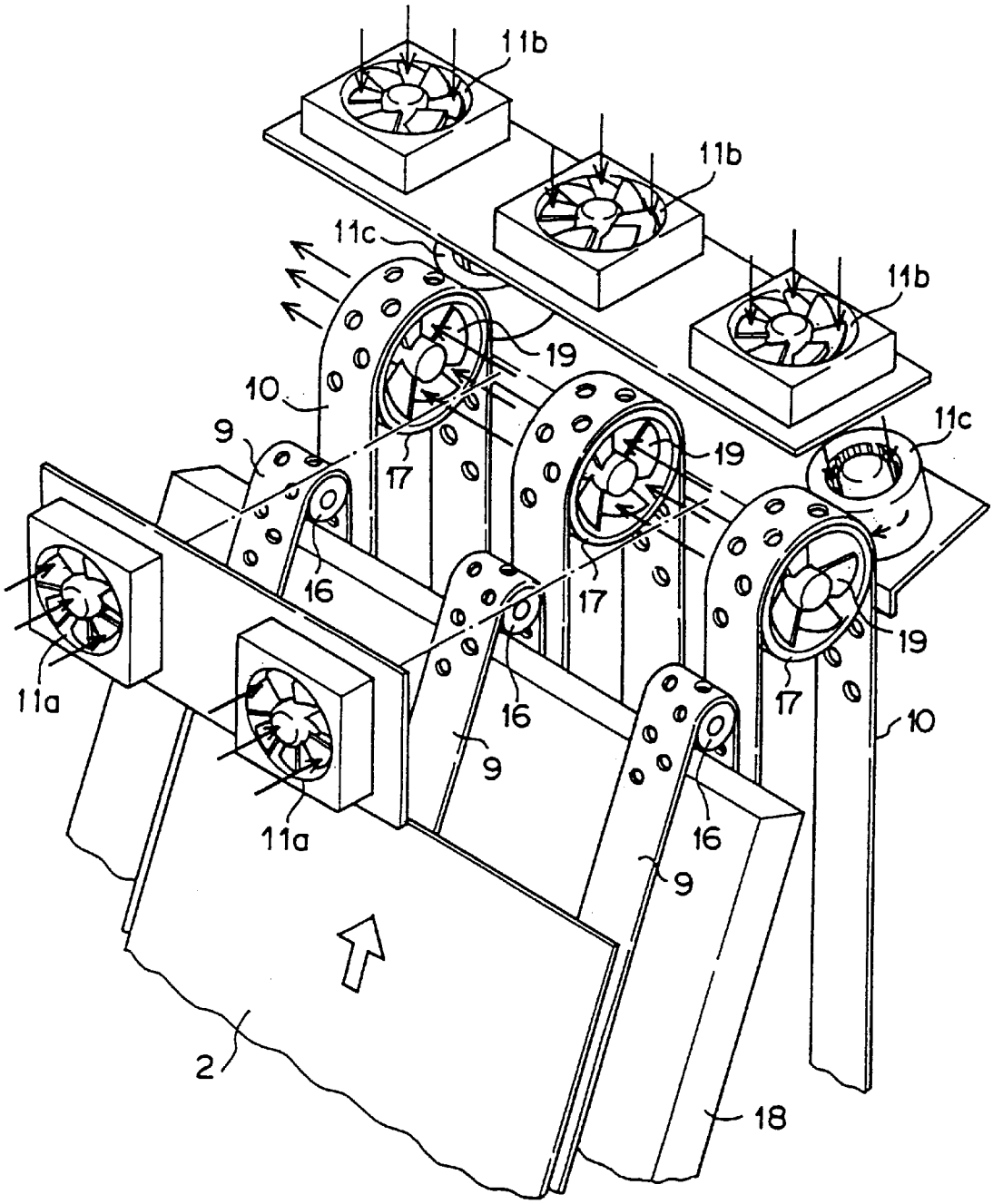
FIG. 4 is an exploded perspective view showing the bent portion of the conveyance passage of the sheet transfer system of this embodiment.

A specific structure of the sheet transfer system 5 will be described in detail with reference to FIGS. 3 and 4, hereinbelow. As shown in FIG. 2, the first conveyor portion 5A comprises upper and lower sections and the upper and lower sections are substantially the same in structure. Accordingly only the upper section will be described here. As shown in FIG. 4, the upper section of the first conveyor portion 5A comprises three perforated conveyor belts 9 each passed around upper and lower small diameter pulleys 16. The three upper small diameter pulleys 16 are arranged in a row in a direction perpendicular to the sheet conveyance direction at the upper end of the first conveyor portion 5A and the three lower small diameter pulleys 16 are arranged in a row in a direction perpendicular to the sheet conveyance direction at the lower end of the first conveyor portion 5A. Only a part of perforations in the conveyor belts 9 are shown in FIG. 4 and only the upper small diameter pulleys 16 are shown in FIG. 4. A box-like duct 18 is disposed on the back side of the conveyor belts 9. The inside of the duct 18 is kept under vacuum by the suction blowers 8 (FIG. 2) and an opening (not shown) is formed in the surface of the duct 18 facing the upper run of the conveyor belts 9 so that the sheet 2 on the conveyor belts 9 is attracted against the front side of the belts 9 under vacuum.

The second conveyor portion 5B comprises three perforated conveyor belts 10 each passed around upper and lower larger diameter pulleys 17. The three upper larger diameter pulleys 17 are arranged in a row in a direction perpendicular to the sheet conveyance direction at the upper end of the second conveyor portion 5B or the bent portion 5C and the three lower larger diameter pulleys 17 are arranged in a row in a direction perpendicular to the sheet conveyance direction at the lower end of the second conveyor portion 5B. Only a part of perforations in the conveyor belts 10 are shown in FIG. 4 and only the upper larger diameter pulleys 17 are shown in FIG. 4. Though not shown, a duct similar to the duct 18 of the first conveyor portion 5A is disposed on the back side of the conveyor belts 10 so that the sheet 2 on the conveyor belts 10 is attracted against the front side of the belts 10 under vacuum. Further though not shown, a pair of guide members extend along the conveyor belts 10 among them at the bent portion 5C.

First to third air blower assemblies are arranged in the direction of conveyance around the bent portion 5C and blow air flows toward the surfaces of the conveyor belts 10 so that the sheet 2 on the belts 10 is bent along the bent portion 5C by the pressure of the air flows and is conveyed to the indexer 6 by the second conveyor portion 5B through the bent portion 5C as the conveyor belts 10 run.

The first air blower assembly is disposed on the first conveyor portion side of the top of the bent portion 5C and comprises a pair of axial flow air blowers 11*a* arranged in a direction perpendicular to the conveyance direction. The air flows from the air blowers 11*a* are directed slightly downstream to give the leading end portion of the sheet 2 approaching the bent portion 5C occasion to bend along the bent portion 5C.

The second air blower assembly is disposed opposed to the top of the bent portion 5C and comprises three axial flow air blowers 11*b* arranged in a direction perpendicular to the conveyance direction. The air flows from the air blowers 11*b* are directed slightly downstream to wind the sheet 2 around the bent portion 5C. The air flow rate of the air flows from the second air blower assembly opposed to the top of the bent portion 5C is larger than those from the other air blower assemblies.

The third air blower assembly is disposed on the second conveyor portion side of the top of the bent portion 5C and comprises a pair of centrifugal air blowers 11*c* arranged in a direction perpendicular to the conveyance direction. The air blowers 11*c* are arranged to blow air flows in their circumferential directions due to spatial limitation. The air flows from the air blowers 11*c* are directed slightly downstream to keep flat the leading end portion of the sheet 2 along the surfaces of the conveyor belts 10 at the boundary between the bent portion 5C and the flat portion.

Exhaust fans 19 are provided inside of the bent portion 5C to exhaust air in a direction perpendicular to the direction of conveyance of the sheets 2.

The exhaust fans 19 are formed by propeller-like arms of the larger diameter pulleys 17 which are rotated about a rotational axis perpendicular to the direction of conveyance of the sheets 2. The exhaust fans 19 discharge excessive air flow outside the sheet sorter S through a side wall of the sorter S near the back side thereof, thereby preventing a turbulent flow inside the bent portion 5C.

The strength of the air flows blown from the air blower assemblies opposed to the bent portion 5C is adjustable according to the kind of sheets 2 to be conveyed. More specifically, the kind of sheets 2 is determined on the basis of information on the resiliency of the sheets 2 and, for example, the strength of the air flows is increased as the thickness of the sheets 2 increases on the basis of sheet thickness information.

In the image recording apparatus 1, there is generally provided a manual or automatic adjustment mechanism for adjusting the printing pressure and the like according to the thickness of the sheets. Accordingly it is preferred that the flow rate of the air flows be adjusted on the basis of the sheet thickness information obtained from the adjustment mechanism.

Otherwise the sheet thickness information may be set through an input means such as a control panel provided on the image recording apparatus or the sheet sorter.

By adjusting the flow rate of the air flows from the air blower assemblies so that the air pressure on the sheets is increased to increase the bending force as the thickness of the sheets increases, thereby bringing the sheets into close contact with the surface of the conveyor belt 10, and the air pressure on the sheets is reduced as the thickness of the sheets reduces, thereby preventing the back side of the sheets from being pressed against a part other than the conveyor belt 10, the sheets can be successfully conveyed along the bent portion 5C.

An outer guide member 31 is disposed outside the top of the bent portion 5C in order to prevent the sheets 2 from scattering, for instance, when the air blower assemblies are not operating. Further a flap 32 is mounted for rotation about a pivot pin 32*a* near the bent portion 5C. The flap 32 is rotated in the counterclockwise direction in FIG. 3 so that its one arm is brought into contact with the upper surface of the conveyor belt 10 when the sheets 2 are to be delivered to the sheet conveyor 12 which transfers the sheets 2 to the slaves S'.

Though, in the embodiment described above, the flow rate of the air blower assemblies is adjusted according to the thickness of the sheets, the flow rate of the air blower assemblies may be adjusted according to the density of the sheets so that the flow rate is increased as the density of the sheets increases. The control means for adjusting the flow rate may be provided either on the image recording apparatus or on the sheet sorter.

What is claimed is:

1. A sheet transfer system for conveying a sheet along a conveyance passage including a bent portion characterized in that an air blower is provided to blow an air flow against a sheet being fed on a conveyance surface at the bent portion of the conveyance passage to urge the sheet on the conveyance surface so that the sheet is bent along the surface of the conveyance surface, and a conveyor belt which attracts the back side of the sheet under vacuum is provided with the conveyor belt being bent along a pulley at the bent portion of the conveyance passages said conveyance surface being the upper surface of the conveyor belt.

2. A sheet transfer system as defined in claim 1 further comprising an exhaust fan which exhausts air in a direction perpendicular to the direction of conveyance of the sheet inside of the bent portion of the conveyance passage.

3. A sheet transfer system as defined in claim 2 in which the exhaust fan is provided inside of the pulley along which the conveyor belt is bent and which is rotated about a rotational axis perpendicular to the direction of conveyance of the sheet.

4. A sheet transfer system as defined in any one of claims 1 to 2 in which said air blower means comprises a plurality of air blowers which are arranged in the direction of conveyance around the bent portion with at least one of the air blowers positioned so as to blow an air flow against the top portion of bent portion, and the air flow from said at least one of the air blowers is stronger than those from the other air blowers.

5. A sheet transfer system as defined in claim 1 in which the strength of the air flow blown from the air blower means is adjustable according to the kind of sheet to be conveyed.

6. A sheet transfer system as defined in claim 5 in which the strength of the air flow blown from the air blower means is increased as the thickness of the sheet to be conveyed increases.

* * * * *